United States Patent [19]

Schiel

[11] B 3,992,253

[45] Nov. 16, 1976

[54] PAPERMAKING MACHINE HAVING A SUCTION ZONE FREE OF WIRE SUPPORTS

[75] Inventor: Christian Schiel, Heidenheim-Schnaitheim, Germany

[73] Assignee: J. M. Voith, GmbH, Heidenheim (Brenz), Germany

[22] Filed: June 12, 1974

[21] Appl. No.: 478,739

[44] Published under the second Trial Voluntary Protest Program on February 17, 1976 as document No. B 478,739.

[30] Foreign Application Priority Data

June 20, 1973 Germany ..... 2331313

[52] U.S. Cl. ..... 162/290; 162/301; 162/306; 162/351; 162/364

[51] Int. Cl.[2] ..... D21F 1/52; D21F 9/02

[58] Field of Search ..... 162/290, 301, 306, 307, 162/308, 312, 313, 314, 348, 350, 351, 363, 364, 368, 201, 203, 207, 210, 366, 211

[56] References Cited

UNITED STATES PATENTS

| | | | |
|---|---|---|---|
| 2,881,671 | 4/1959 | Thomas | 162/301 |
| 3,079,990 | 3/1963 | Taylor et al. | 162/350 |
| 3,441,476 | 4/1969 | Schiel | 162/306 |
| 3,565,757 | 2/1971 | Jordansson | 162/301 |
| 3,694,311 | 9/1972 | Skeppstedt | 162/290 |
| 3,726,758 | 4/1973 | Parker et al. | 162/203 X |

*Primary Examiner*—S. Leon Bashore
*Assistant Examiner*—Richard V. Fisher
*Attorney, Agent, or Firm*—Melvin A. Crosby

[57] ABSTRACT

A papermaking machine of the Fourdrinier type having a machine wire which passes about a breast roll adjacent a head box and which passes around a further curved guide member spaced from the breast roll and about which guide member there is also entrained a belt in the form of a felt or additional wire. Beneath the machine wire between the breast roll and the curved guide member is a suction region which is characterized in that it is free of any wire supports or the like which would create pressure impulses in the suspension on the wire, which pressure impulses would interfere with the formation of the paper sheet.

11 Claims, 10 Drawing Figures

PAPERMAKING MACHINE HAVING A SUCTION ZONE FREE OF WIRE SUPPORTS

The present invention relates to a papermaking machine of the Fourdrinier type, especially such a machine with a long machine wire and a belt in the form of a felt or additional wire which is brought together with the machine wire about a curved guide member spaced from the head box of the machine.

In the West German Pat. No. 1,116,966, there is shown a Fourdrinier papermaking machine of the general type referred to above. If such a machine is employed for the production of sensitive papers, such as extremely thin papers, and with the machine operating at a high velocity, difficulty occurs in connection with removing the water from the suspension because the water must be drained out rapidly but, at the same time, in a gentle manner and without creating pressure pulsations in the suspension on the machine wire which would interfere with the formation of the paper sheet.

Problems are, also, encountered in connection with removing the paper sheet from the wire cloth, as with a felt or the like.

The present invention deals with the solution of the problem of constructing a Fourdrinier papermaking machine having a long machine wire in which the difficulties referred to above are overcome.

The problem referred to is solved by the present invention by establishing a formation zone in which the paper sheet forms on the wire and which is free of supporting members such as listels, register rolls, foils, and the like, any of which when brought in supporting relationship, or closely adjacent relationship, with the machine wire through which water is draining can create pressure pulsations in the suspension on the wire which will interfere with the formation of the paper sheet thereon.

More particularly, a further belt in the form of a felt or a wire is provided, and this is entrained about a curved guide member spaced from the head box of the machine, and the formation zone provided is in the form of a suction zone which extends beneath the wire from adjacent the breast roll at the head box end of the wire to and, in some cases, partly or completely around, the region of the curved guide member about which the machine wire and the aforementioned belt are entrained.

Maintaining the formation region along the machine wire completely free from supporting parts of the nature referred to above eliminates the objectionable pressure pulsations that can be created in the suspension thereby and the result is that the paper sheet produced is extremely uniform throughout. The suction zone which effects the preliminary dewatering of the suspension, reduces the water content in the suspension so that the removal of water by the suction zone together with the water removed in the region of the curved guide member, and even at high operating speeds of the papermaking machine, will insure that the paper sheet is fully formed and can be handled without difficulty.

The draining of water from the suspension along the formation zone preceding the region where the machine wire and the additional belt come together about the curved guide member is, as mentioned, rather gentle, and is accomplished under the action of only a small suction head and by maintaining the suction rather low, a decisive contribution is made toward bringing about the production of a paper sheet characterized in a minimum of wire marking and with high fiber retention.

The suction zone may end at a region inside the range of the curved guide member and, in this case, air is advantageously aspirated independently of the suction zone and within the range of the guide member, as though a slot provided in the guide member if the guide member is stationary or through perforations in the guide member if the guide member is in the form of a rotary cylinder. The air thus aspirated will entrain finely distributed water droplets from the machine wire and from the paper sheet.

In a preferred arrangement of the invention, the paper sheet separates from the machine wire while the machine wire is still within the range of the curved guide member, then it is preferred for the adjacent end boundary wall of the suction zone to be arranged shortly behind the region of separation of the paper sheet from the machine wire.

In this case, the aforementioned suction zone boundary wall may make direct contact with the machine wire and, in this manner, air becomes aspirated between the machine wire and the paper sheet which further reduces the amount of water in the paper sheet, thereby improving the characteristics of the sheet for the handling thereof during subsequent procedural operations carried out on the paper sheet, such as the pressing or drying thereof.

It has been found that when a paper sheet is processed in the aforesaid manner, there is no need for any additional purifying of the paper sheet, which is to say, removing of water therefrom in the form of water droplets. Rather, the paper sheet, as soon as it leaves the formation zone, may immediately be subjected to the subsequent procedural steps or operations referred to above.

Another, and, also, advantageous embodiment of the invention finds at least the lateral walls of the suction zone extending beneath the machine wire so disposed that the upper edges thereof are spaced a short distance from the machine wire. This prevents the development of pressure pulsations in the suspension on the wire and, furthermore, permits the suction applied to the underside of the wire to be rather low. It is particularly advantageous if the upper edges of the lateral walls are concave toward the wire whereby the machine wire between the breast roll and the curved guide member can assume a curved configuration without engaging the upper edges of the lateral boundary walls of the suction zone.

It is also proposed for the suction zone to be provided with a frontal wall at the head box end which sealingly engages the periphery of the breast roll about which the wire passes on a circumferential region of the breast roll which is not engaged by the wire. The sealing engagement of the frontal wall with the breast roll in the described manner may be effected without actual contact of the breast roll by the frontal wall merely by disposing the frontal wall in close juxtaposition to the breast roll.

By so disposing the frontal wall in sealing relation to the breast roll of the machine, the suction commences to act on the suspension from the apex of the breast roll where the machine wire separates therefrom and, accordingly, a jet of suspension from the head box may be caused to impinge on the machine wire at the apex of the breast roll. In this case, it is preferred to construct the breast roll as a dandy roll.

A still further feature according to the present invention occurs when the rearward boundary wall of the suction zone, which is that boundary wall furthest away from the breast roll, is located about where the machine wire separates from the curved guiding member. By so locating the rearward boundary wall of the suction zone, it is brought about, after centrifugal force has acted for a maximum length of time upon the water which was squeezed out from the paper sheet and into the machine wire, that air becomes aspirated between the rearward boundary wall of the suction zone and the machine wire thereby drawing the water out from the machine wire.

If the rearward boundary wall of the suction zone is located in a staggered manner, the air aspirated from between the machine wire and the paper sheet will favorably promote the drying of the paper sheet upon the separation thereof from the machine wire.

The aforementioned guide member referred to may be cylindrical and rotate, but it is also possible for the guide member to be a stationary curved member and can be made, in fact, of several curved portions, one portion of which may rotate and another portion be stationary.

The nature of the present invention will be more clearly understood upon reference to the following detailed specification taken in connection with the accompanying drawings in which.

DETAILED DESCRIPTION OF THE INVENTION

Figure 1:
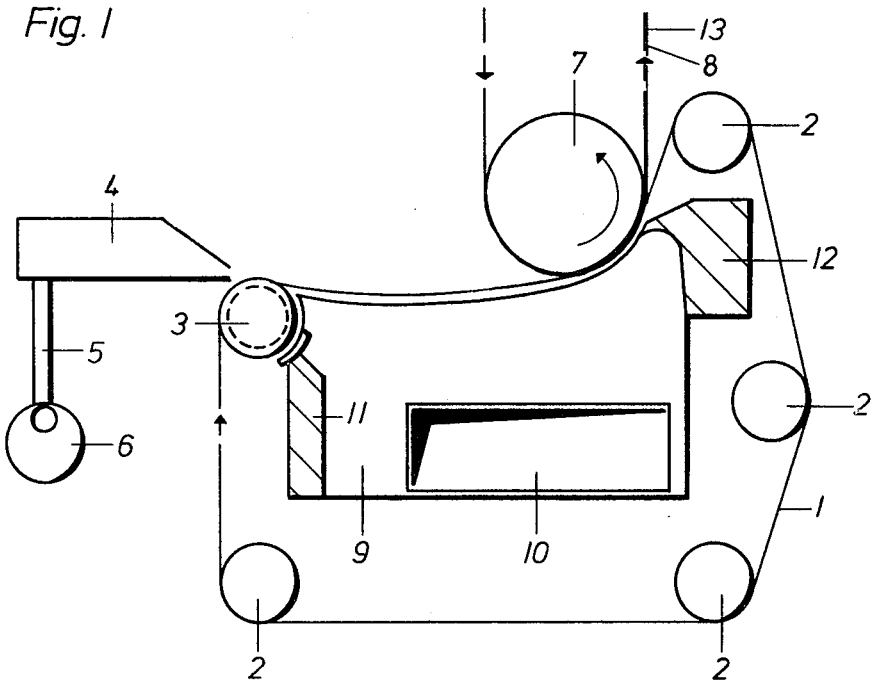
FIG. 1 is a schematic showing of a Fourdrinier type papermaking machine having a long machine wire and having a cylinder spaced from the breast roll of the machine and forming a curved guiding member for the machine wire and the belt cooperating therewith.

Referring to the drawings somewhat more in detail, the machine wire in each of the illustrated modifications is designated by reference numeral 1. This wire is in the form of an endless wire and is guided in its path by guide rollers 2 and at a region adjacent head box 4 is entrained about a breast roll 3. Head box 4, and which may be a closed head box, is supplied with suspension via a plurality of distribution pipes 5 which are connected to a supply header 6. The suspension supply is preferably pressurized and the head box 4 supplies a jet of suspension as wide as the machine to the upper side of machine wire 1.

In FIG. 1, a felt belt 8 is entrained about cylinder 7 and the wire 1 is also entrained about the cylinder so that belt 8 is pressed by cylinder 7 against the machine wire 1.

It is understood that, at this point in the machine, the suspension supplied by head box 4 to wire 1 has been drained to the point that there is a recognizable paper sheet disposed between belt 8 and wire 1 where the belt and wire run together. The machine wire 1 is entrained about the cylinder 7 over an angle of about 45°, and this represents the angular range over which the machine wire 1 and belt 8 run together in engagement with opposite sides of the paper sheet.

Underneath wire 1 between breast roll 3 and cylinder 7, there is arranged a suction box 9 having a water outlet 10 in the bottom. The suction box 9 has a frontal wall 11 at the breast roll end and, in FIG. 1, frontal wall 11 is positioned in sealing relation to breast roll 3, either through direct contact with the roll, or by terminating in a curved region disposed closely adjacent the periphery of the breast roll. The region of sealing engagement of frontal wall 12 with breast roll 3 is disposed in a peripheral region of the breast roll which is not engaged by wire 1.

The suction box also has a rearward wall at the end opposite the head box end of the suction box and, in FIG. 1, the rearward wall 12 of the suction box is located in the region where the machine wire 1 separates from cylinder 7. The edge of rearward wall 12 which is nearest cylinder 7 does not engage the machine wire 1 so that a gap is left between wall 12 and wire 1 between which air is aspirated into the suction zone.

This air will pick up droplets of water from the machine wire and the paper sheet and effects an additional drying of the paper sheet which will improve the manner in which the paper sheet separates from the machine wire. Furthermore, the flow of air between the machine wire and the edge of rearward wall 12 prevents water from being thrown off from the machine wire in the tangential direction due to the rather substantial centrifugal forces that build up when the machine is operating at high speed.

In the modification of FIG. 1, the paper sheet, indicated at 13, follows belt 8 and is conveyed thereby into a press section or to a drying cylinder, neither of which have been illustrated in connection with FIG. 1.

Figure 2:
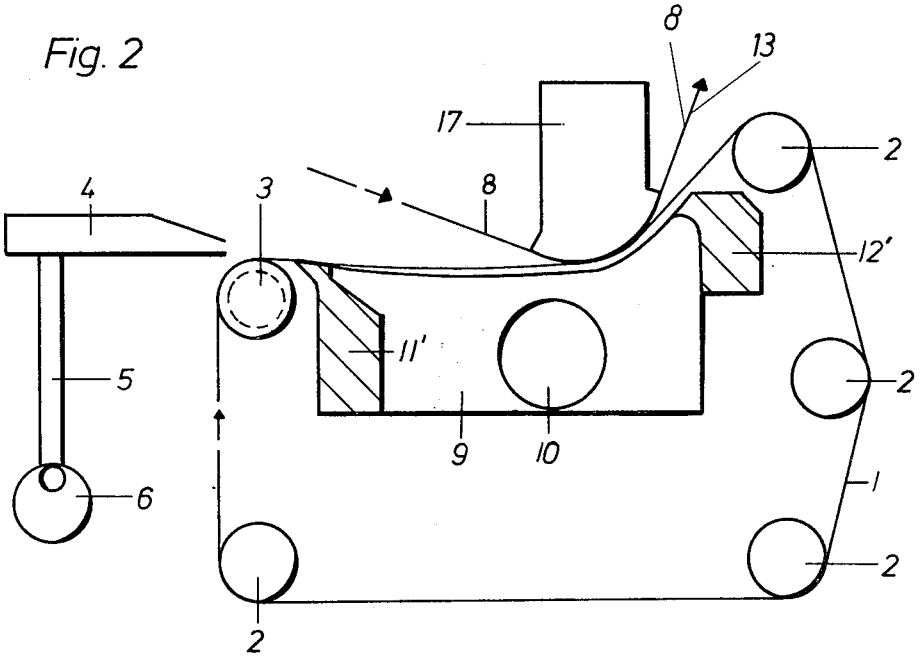
FIG. 2 shows an embodiment similar to that of FIG. 1 but having a stationary member forming the guide member and having the frontal wall of the suction zone located behind the breast roll of the machine.

In FIG. 2, which shows a machine similar to that illustrated in FIG. 1, the cylinder 7 is replaced by a stationary shoe 17 extending transverse to the machine wire 1 and having a curved surface on the side where the shoe is engaged by the belt 8 and the wire 1. In FIG. 2, the frontal wall 11' of the suction box will be seen to approach and engage the underside of the machine wire 1 after the machine wire has left the breast roll 3.

Furthermore, the head box 4 will be seen to be arranged in FIG. 2 so that the jet of suspension leaving the head box will impinge on the machine wire 1 in the region where the machine wire 1 is engaged by the upper edge of frontal wall 11 of the suction box.

The rearward wall 12′ of the suction box of FIG. 2 will be seen to be displaced rearwardly somewhat from the place where the machine wire 1 separates from the curved guide surface of guide shoe 17. By so locating rearward wall 12′ of the suction box, air becomes aspirated between the paper sheet 13 which follows the belt 8 and the machine wire 1 and this assists in removing residual water which is in the wire 1 and any water which is on the wire side of the paper sheet 13.

Figure 3:
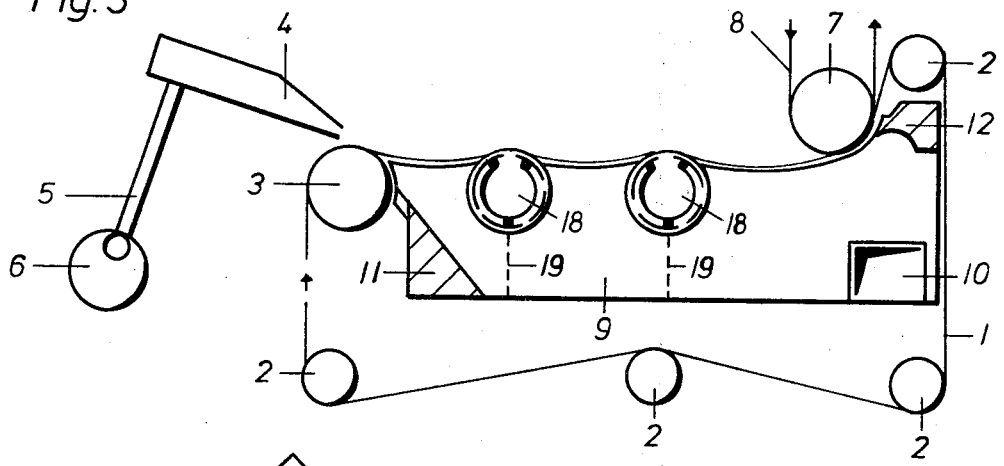
FIG. 3 shows a modification in which the machine wire is, within the formation zone between the breast roll and the guide member, supported by two or more suction rolls.

In FIG. 3, the machine wire 1 within the longitudinal range of the suction box and between breast roll 3 and cylindrical guide member 7, is guided across a pair of longitudinal spaced suction rolls 18. The suction rolls 18 engage and guide the machine wire but have open surfaces on the side facing the wire and suction is exerted thereon so that an aspirating action is obtained and this eliminates pressure pulsations that might otherwise arise in the suspension on the wire.

Separating walls 19, which are schematically indicated in FIG. 3, extend downwardly from suction rolls 18 whereby the suction box 9 may be divided into three chambers and independent suction control can be exerted in each chamber, it being understood that, in the case of independent suction control, each subchamber of the suction box 9 would have an independent water outlet.

It is also possible to employ the separating walls 19 without the suction rolls 18 but, in this case, care must be taken to make sure that the upper edges of the separating walls are spaced from the machine wire far enough to avoid creating pressure pulsations in the suspension on the wire.

Figure 4:
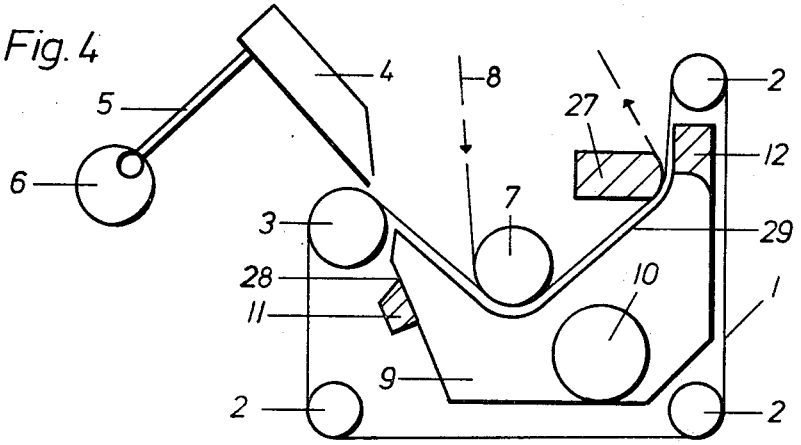
FIG. 4 shows a modification in which the guide member consists of a cylinder and a following stationary curved guide shoe.

In FIG. 4, the machine wire 1 passes downwardly at an angle from breast roll 3 to the cylindrical guide member 7 and then extends upwardly at an angle to a stationary curved shoe 27. The raised curvature of the curved guide face of shoe 27 is smaller than that of cylinder 7. In the FIG. 4 modification, frontal wall 11 of suction box 9 is provided with a scraper element 28 which makes contact with the breast roll 3 in a region spaced from the point where the wire 1 separates from breast roll 3.

The rearward wall 12 of the suction box is disposed in a region adjacent shoe 27, but it is also possible for the rearward wall to be disposed within the range of cylindrical guide member 7 and to provide the shoe 27 with a water collecting groove arrangement.

In the web forming region, generally indicated at 29, and disposed between cylindrical guide member 7 and shoe 27, it is not necessary to maintain a negative pressure on the paper sheet being formed.

Figure 5:
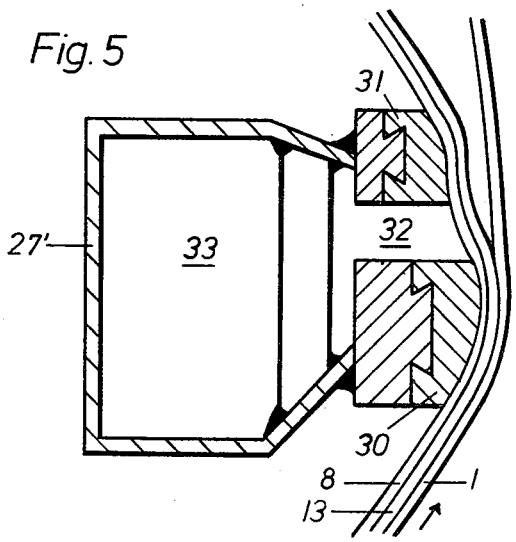
FIG. 5 is a section through the guide shoe of FIG. 4 showing how the guide shoe can be formed with a slot for exerting suction on the belt and paper-sheet passing about the guide member.

FIG. 5 shows one manner in which the shoe 27 in FIG. 4 can be constructed. In FIG. 5, the shoe is indicated at 27′ and is formed of a tubular member on the front of which is mounted transversely extending rails or listels 30 and 32 and between which there is defined a slot 32 that is connected to space 33 inside the tubular support member. Suction applied to the tubular support member 33 will apply suction to belt 8 and therethrough to paper sheet 13. The formation of the rails 30 and 31 with rail 31 displaced from the path taken by wire 1 facilitates separating the paper sheet from the wire.

Figure 6:
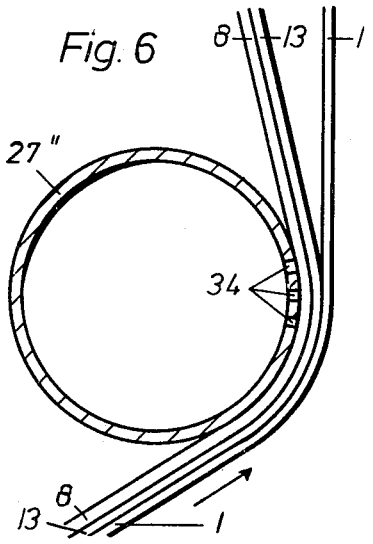
FIG. 6 shows a modification in which the stationary guide shoe of FIG. 4 is in the form of a tubular body having suction openings on the side facing the belt entrained thereabout.

FIG. 6 shows a nonrotatable but cylindrically shaped tubular shoe 27′ which could be employed for the stationary shoe portion of the curved guide member as shown at 27 in FIG. 4. Member 27′ and about which belt 8 and wire 1 with the paper sheet 13 interposed therebetween loops is provided with suction openings 34 through which negative pressure will act upon the belt 8 and paper sheet 13 and thereby retain the paper sheet on the felt web for separation thereof from the machine wire 1.

Figure 7:
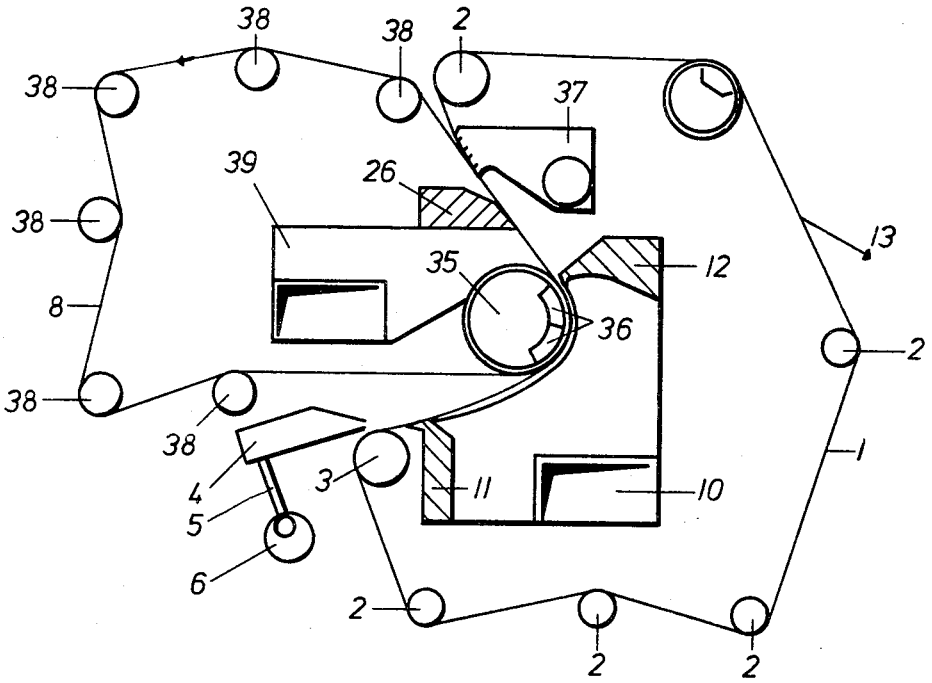
FIG. 7 shows a modification in which the guide member is in the form of a suction roll.

FIG. 7 shows an embodiment in which the curved guide member is in the form of a perforated cylinder 35 which is rotatable and about which is entrained the wire 1 and the additional belt 8 which, in this case, is also in the form of a wire. Cylinder 35 is provided with a pair of suction chambers 36 opposed to the peripheral region of the cylinder which is engaged by the webs. The paper sheet 13 in the FIG. 7 arrangement does not separate from wire 1 within the range of the curved guide member but continues with the machine wire and is separated therefrom at the right side of the machine as it is viewed in FIG. 7.

In FIG. 7, machine wire 1 runs upwardly at an incline from breast roll 3 where it receives suspension from head box 4 and then extends upwardly in a reverse direction from cylinder 35 and during upward movement thereof passes over a suction box 37. Suction box 37 is located within the range where wire 1 and belt 8 separate and due to the suction exerted through wire 1 on the paper sheet, the paper sheet will follow wire 1 when the wire separates from belt 8.

The suction box in FIG. 7 modification is confined between frontal wall 11 adjacent head box 3 and rearward wall 12 adjacent the region where the wire and belt separate from cylinder 35, thus, disposing rearward wall 12 in a substantially horizontal position.

A further container 39 is provided adjacent cylinder 35 to catch water thrown off from the cylinder and has a water outlet from which the water is drained. Suction may be applied to container 39 if desired. Between cylinder 35 and the aforementioned suction chamber 38, there is provided a transversely extending guide wall 26 which engages or is close to the back of wire 8 and serves as a confining wall for chamber 39.

Figure 8:
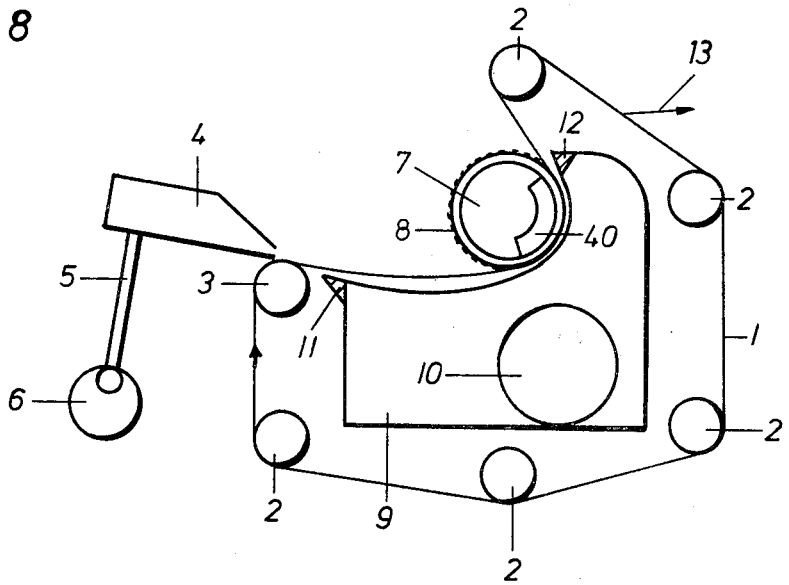
FIG. 8 shows a modification in which the guide member is in the form of a roll and the belt entrained thereabout is in the form of a wire jacket on the roll, the roll in this case being formed for supplying air under pressure to the paper side of the machine wire.

FIG. 8 illustrates a modification in which the belt 8 of the machine is in the form of a wire jacket mounted on the rotatable guide cylinder 7. Cylinder 7 is provided with a perforated periphery and mounted therein is a member 40 which is pressurized so that air blows outwardly therefrom and holds paper sheet 13 on wire 1 where wire 1 separates from belt 8.

The suction box 9 is confined by frontal wall 11 adjacent head box 3 and by rearward wall 12 which terminates adjacent the point of separation of wire 1 from jacketed cylinder 7. As before, head box 4 supplies a jet of suspension to wire 1 and is, in turn, supplied from the suspension supply chamber 6 via conduits 5.

Figure 9:
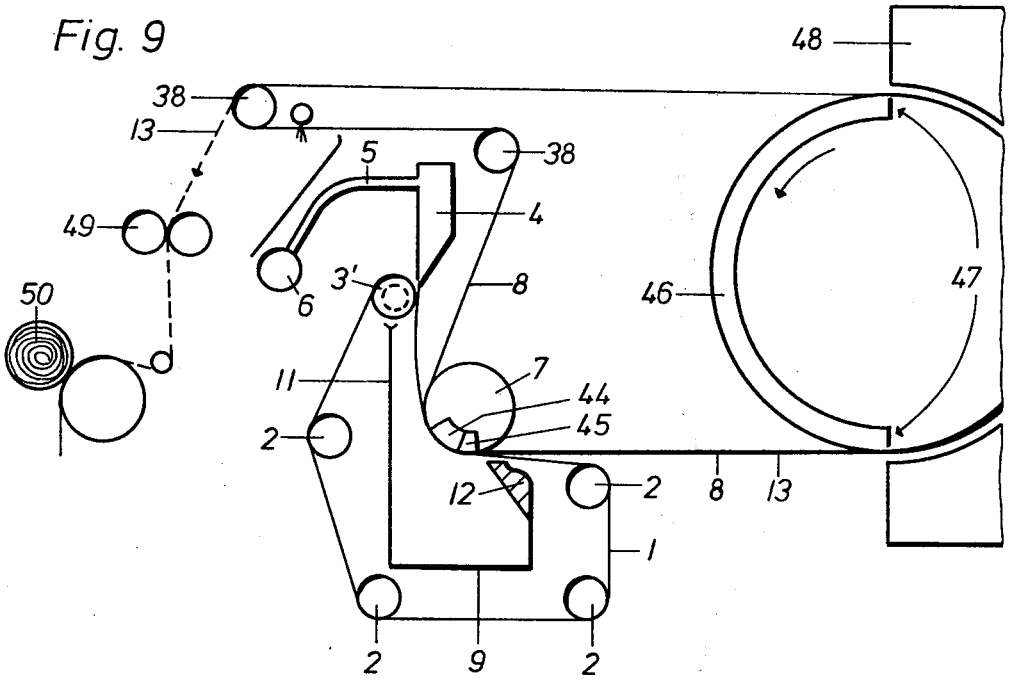
FIG. 9 illustrates a modification in which the curved guide member is provided with both pressure and suction zones.

FIG. 9 shows a somewhat different arrangement wherein head box 4 is arranged so as to supply the jet of suspension substantially vertically downwardly toward wire 1 with the breast roll 3′ in the case of the FIG. 9 modification being perforated. Frontal wall 11 of the suction box 9 is disposed in substantially vertical alignment with breast roll 3′ while rearward wall 12 thereof is disposed adjacent the point about cylindrical and rotatable guide member 7 where the wire 1 separates from the guide member.

Within cylinder 7 in FIG. 9 are two chambers 44 and 45 with chamber 44 adapted for supplying pressure within the range of perforated cylinder 7 covered thereby while chamber 45 supplies suction to the periphery of roll 7 over the respective range. The pressure supplied by box 44 forces water from the paper sheet through wire 1 whereas the suction from chamber 45 will hold the paper sheet 13 on the surface of belt 8 which, in this case, is a felt. The paper web 13 is conveyed by belt 8 through a drier 48 and about a cylinder 46 which is perforated and which has suction developed on the inside thereof about the peripheral range indicated by reference numeral 47.

After the belt 8 and paper sheet 13 leave the drier, the paper sheet 13 is separated from belt 8 at reversing roll 38 and the paper sheet then proceeds through an embossing calendar 49 and is then guided to a reeling device or guiding device 50.

Figure 10:
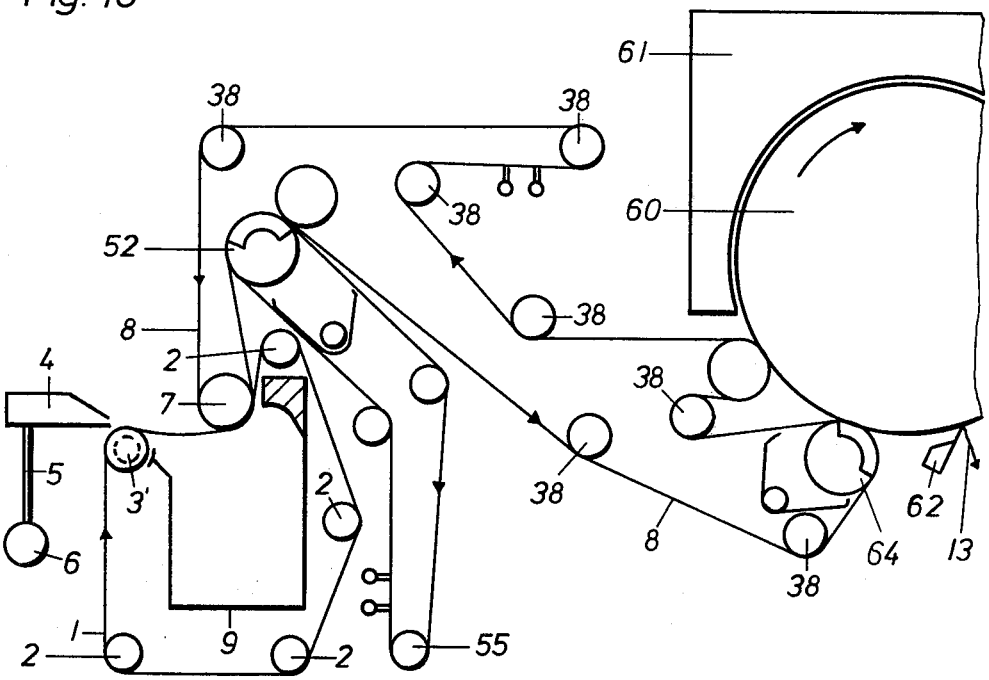
FIG. 10 shows a modification in which the machine is provided with a perforated breast roll that can be connected to a source of suction.

FIG. 10 shows an embodiment which is provided with a perforated breast roll 3′ and about which the machine wire 1 is entrained. The second belt 8 in the modification of FIG. 10 is in the form of a felt. The belt 8 and wire 1 are entrained about rotatable curved cylinder guide member 7 with the suction box 9 developing suction on the wire between breast roll 3 and guide member 7.

The paper sheet transfers from wire 1 to belt 8 where the wire and belt separate upon leaving guide member 7. The belt and paper sheet then pass about a suction roll 52 and the paper sheet is then conveyed on belt 8 to a drier cylinder 60. Suction roll 52 has a web 53 entrained thereover which leads downwardly and about a reversing roll at the bottom. A catch basin 57 may be provided beneath suction roll 52 to catch water picked up by roll 52 from belt 8 and the paper sheet.

The belt 8 runs about a cylinder 64 where it approaches cylinder 60 so that the paper sheet is transferred from belt 8 to cylinder 60. Cylinder 60 runs inside a hood 61 which is supplied with hot air to dry the paper sheet and upon emerging from hood 61 the paper sheet is removed from cylinder 60, as by scraper member 62, and in which case the paper may be creped.

In each of the modifications illustrated and described, the same reference numerals have been employed where applicable.

It will also be appreciated that wire 1 is substantially unguided or unsupported during its travel from the breast roll to the curved guide member.

In most cases, the wire follows a curved path between the breast roll at the head box end and the curved guide member and the edges of the lateral walls of the suction box opposed to the wire are correspondingly curved while being slightly spaced from the wire.

Modifications may be made within the scope of the appended claims.

What is claimed is:

1. A papermaking machine having an endless machine wire and a breast roll about which the wire is entrained and a head box for supplying suspension to the wire in the region of the breast roll; an endless belt and a curved guide means both spaced from the breast roll and about which guide means both of said wire and belt are entrained in engagement with opposite sides of the sheet formed on said wire, said machine having means defining a formation zone between said breast roll and curved guide means wherein water drains through the wire from the suspension supplied to the wire, said formation zone on the side of the wire opposite the suspension side being free of wire supporting members which create pressure pulses in the suspension, said means defining the formation zone including suction box means beneath the wire opposite the suspension side of the wire and extending from the region of said breast roll at least to the region of said guide means, said suction box means including boundary walls at the ends and the sides of the formation zone, at least the side boundary walls terminating laterally at the side edges of the wire and being spaced a short distance downwardly from the wire.

2. A papermaking machine according to claim 1 in which the belt and the wire separate upon leaving said guide means and follow separate paths.

3. A papermaking machine according to claim 1 in which said end boundary walls include a rearward wall and a frontal wall, said frontal wall sealing against said breast roll in a circumferential region of the breast roll which is not in engagement with the wire.

4. A papermaking machine according to claim 1 in which said end boundary walls include a rearward wall and a frontal wall, said frontal wall engaging said wire in the region where the wire separates from said breast roll, said head box supplying suspension to the wire in the longitudinal region thereof which is engaged by said frontal wall.

5. A papermaking machine according to claim 1 in which said end boundary walls include a frontal wall at the end nearest said breast roll and a rearward wall at the end nearest said guide means, said rearward wall at the edge nearest said wire being near the region of said guide means where the wire separates from said guide member.

6. A papermaking machine according to claim 1 in which said guide means includes a cylinder.

7. A papermaking machine according to claim 1 in which said guide means includes a cylinder and a shoe following the cylinder, said shoe being nonrotatable and having a radius of curvature which is smaller than that of said cylinder.

8. A papermaking machine according to claim 7 in which said shoe is disposed where the wire separates from the belt and has a suction gap therein extending laterally of the belt and through which suction is applied to the belt to assist in transferring the paper sheet from the wire to the belt.

9. A papermaking machine according to claim 1 in which said guide means is a rotary cylinder and said belt is in the form of a wire jacket on said cylinder.

10. A papermaking machine according to claim 1 in which said guide means includes a cylinder on the suspension side of the wire and a suction shoe following the cylinder and on the opposite side of the wire, said belt also being a wire and separating from the machine wire at said shoe, said paper sheet following said machine wire away from said shoe.

11. A papermaking machine according to claim 1 in which said paper sheet is carried away from said guide means by said belt, and drying means through which said belt passes upon leaving said guide means together with said paper sheet.

* * * * *